United States Patent [19]

Swarthout

[11] Patent Number: 4,508,215

[45] Date of Patent: Apr. 2, 1985

[54] AMMUNITION LOCKING MECHANISM

[75] Inventor: Richard L. Swarthout, Wayne, Mich.

[73] Assignee: The United States of America as represented by the Secretary of the Army, Washington, D.C.

[21] Appl. No.: 485,358

[22] Filed: Apr. 15, 1983

[51] Int. Cl.[3] ..... F42B 37/00

[52] U.S. Cl. ..... 206/3; 89/1.7; 89/34; 206/443; 211/60.1; 211/89

[58] Field of Search ..... 42/87; 89/1 R, 1.7, 89/34; 206/3, 443, 446; 211/13, 89, 4, 49 R, 60 R, 182, 49.1, 60.1; 248/68.1; 414/42, 47

[56] References Cited

U.S. PATENT DOCUMENTS

| | | | |
|---|---|---|---|
| 2,432,802 | 12/1947 | Reynolds | 206/3 |
| 2,445,423 | 7/1948 | Eastman | 211/13 |
| 2,531,543 | 11/1950 | Sutphen | 211/182 |
| 2,762,514 | 9/1956 | McGinn | 211/13 |
| 2,822,730 | 2/1958 | Brennan et al. | 206/3 |
| 2,957,583 | 10/1960 | Busbridge | 211/60.1 |
| 3,231,103 | 1/1966 | Tantlinger | 211/49.1 |
| 4,344,528 | 8/1982 | Perisastry et al. | 206/3 |

*Primary Examiner*—George E. Lowrance
*Assistant Examiner*—Jimmy G. Foster
*Attorney, Agent, or Firm*—Peter A. Taucher; John E. McRae; Robert P. Gibson

[57] ABSTRACT

Mechanism for locking individual rounds of ammunition in a bank of storage tubes disposed in an ammunition supply vehicle. A gang type lock actuator system can be operated to lock all ammunition rounds in place while the vehicle is in transit. Individual rounds can be unlocked when it is desired to transfer a specific number of rounds to a combat vehicle.

3 Claims, 7 Drawing Figures

AMMUNITION LOCKING MECHANISM

GOVERNMENT INTEREST

The invention described herein may be manufactured, used, and licensed by or for the Government for governmental purposes without payment to me of of any royalty thereon.

BACKGROUND AND SUMMARY OF THE INVENTION

This invention relates to mechanism for locking or retaining individual rounds of ammunition in storage tubes or equivalent support racks. A typical installation would involve ten vertical rows of support tubes, nine tubes per row, making a total of ninety tubes. Individual tubes are oriented to be prone or horizontal; the overall installation has a "honeycomb" or "pigeonhole" character. Individual support tubes have internal diameters to fit or accommodate specific ammunition rounds, such as a 155 mm round having a diameter slightly greater than six inch and a weight somewhat greater than one hundred pounds.

The ammunition storage system could be used in military depots or other fixed installations. However my invention was specifically designed for use with ammunition storage racks designed to be placed in track-propelled ammunition supply vehicles, such as the vehicle designated by the U.S. military as the M-992.

The M-992 will have the storage racks in a fixed location in the cargo compartment. Projectiles will be loaded into the racks, using ammunition handling equipment, at a Battalion Supply Facility. After the vehicle has been driven into the battle zone a chain conveyor is extended from the M-992 vehicle to a designated combat vehicle requiring a new supply of ammunition. A crewman in the M-992 vehicle transfers individual rounds from the loaded rack to the conveyor for transmission into the other vehicle.

My invention is concerned particularly with mechanism for locking or retaining individual rounds of ammunition in individual storage tubes of the rack structure. The mechanism includes gang type actuator means for simultaneously locking all rounds in a row of tubes (i.e., ten tubes in the example) or all rounds in the system (ninety tubes in the example), depending on how the rack system is manufactured.

While the ammunition supply vehicle is being driven from the supply point into the battle area the rounds in the storage tubes are locked or retained against inadvertant dislodgement from the tubes. The gang type actuator means is retractible to a standby position wherein individual locking mechanisms are in locked conditions but susceptible to being unlocked when deemed necessary, e.g., when it is necessary to transfer individual rounds into a conveyor system for transfer to a combat vehicle. Manual means is associated with each storage tube for releasing or unlocking the associated ammunition round.

The invention is directed to a ammunition retainer mechanism that features gang type locking action and individual round unlocking action. The general arrangement is somewhat similar to the system shown in U.S. Pat. No. 4,344,528 to Perisastry et al. However, I propose a gang locking feature that is not present in the Perisastry et al system. Also, there are some detailed differences in the lock structures and mechanical effort required to achieve an unlocking action.

THE DRAWINGS

Figures 1, 2:
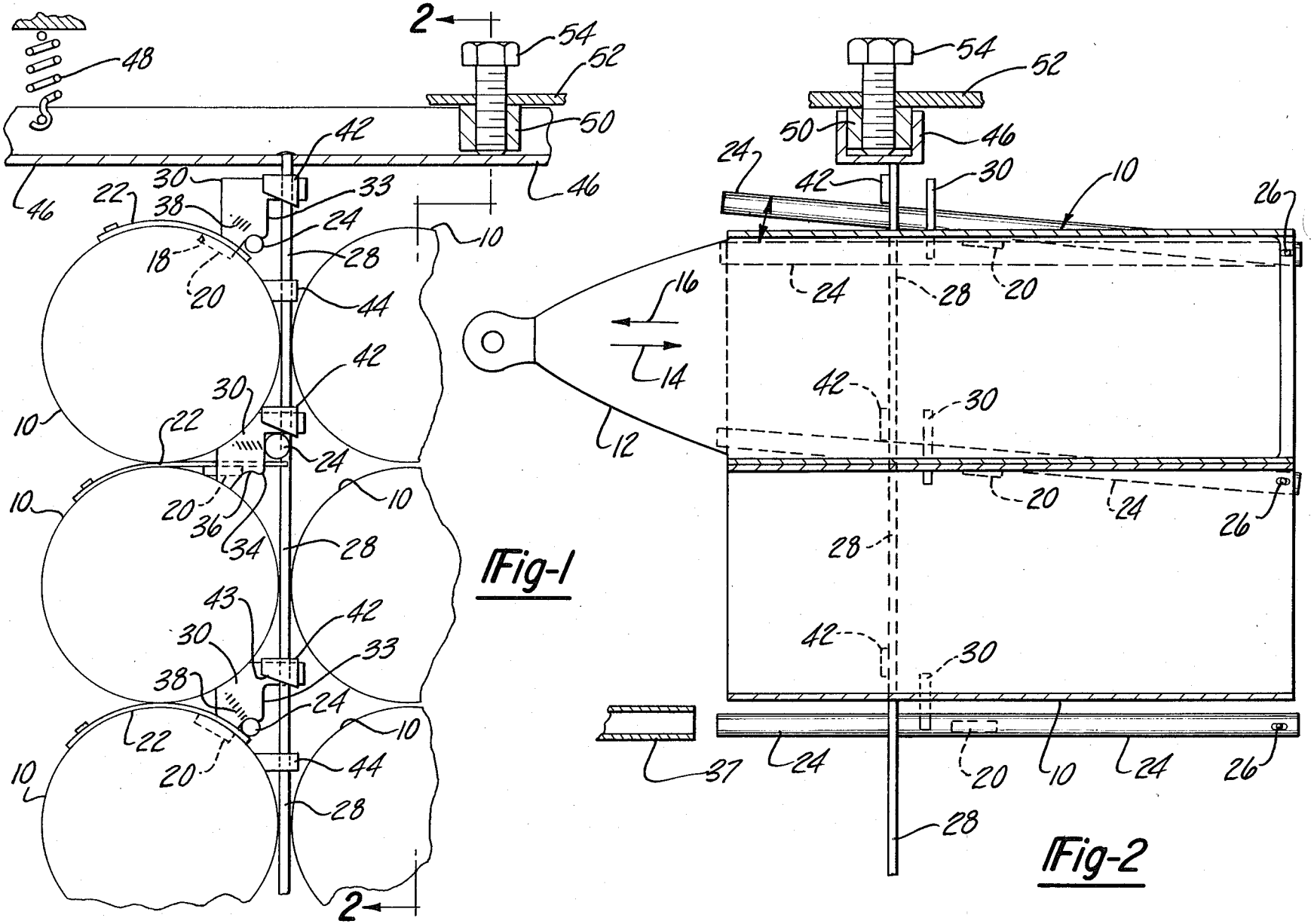
FIG. 1 is a fragmentary elevational view of an ammunition rack system embodying my invention.
FIG. 2 is a fragmentary sectional view taken on line 2—2 in FIG. 1.
Figure 4:
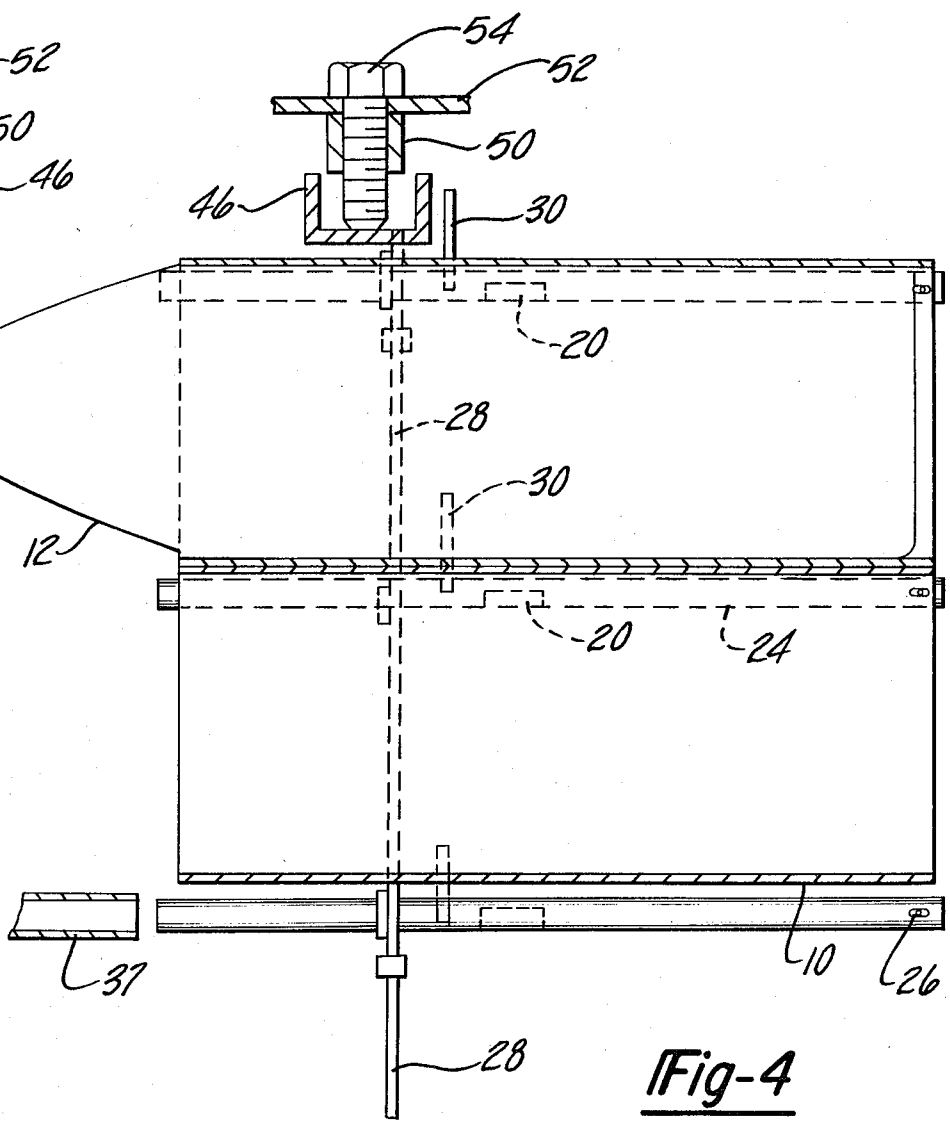
FIGS. 3 and 4 are fragmentary views similar to FIGS. 1 and 2, but showing the mechanisms in a different condition of adjustment.

Referring more particularly to FIGS. 1 and 2, there is shown an ammunition storage rack system that includes two parallel rows of stationary cylindrical tubes 10 for retaining individual ammunition rounds 12 (only one round being shown). The entire rack system would usually comprise a number of horizontal tubes 10 arranged in parallel vertical rows, as close to one another as possible for space conservation purposes. Individual ammunition rounds are manually inserted into tubes 10 in the arrow 14 direction, and removed from the tubes in the arrow 16 direction.

Figure 3:
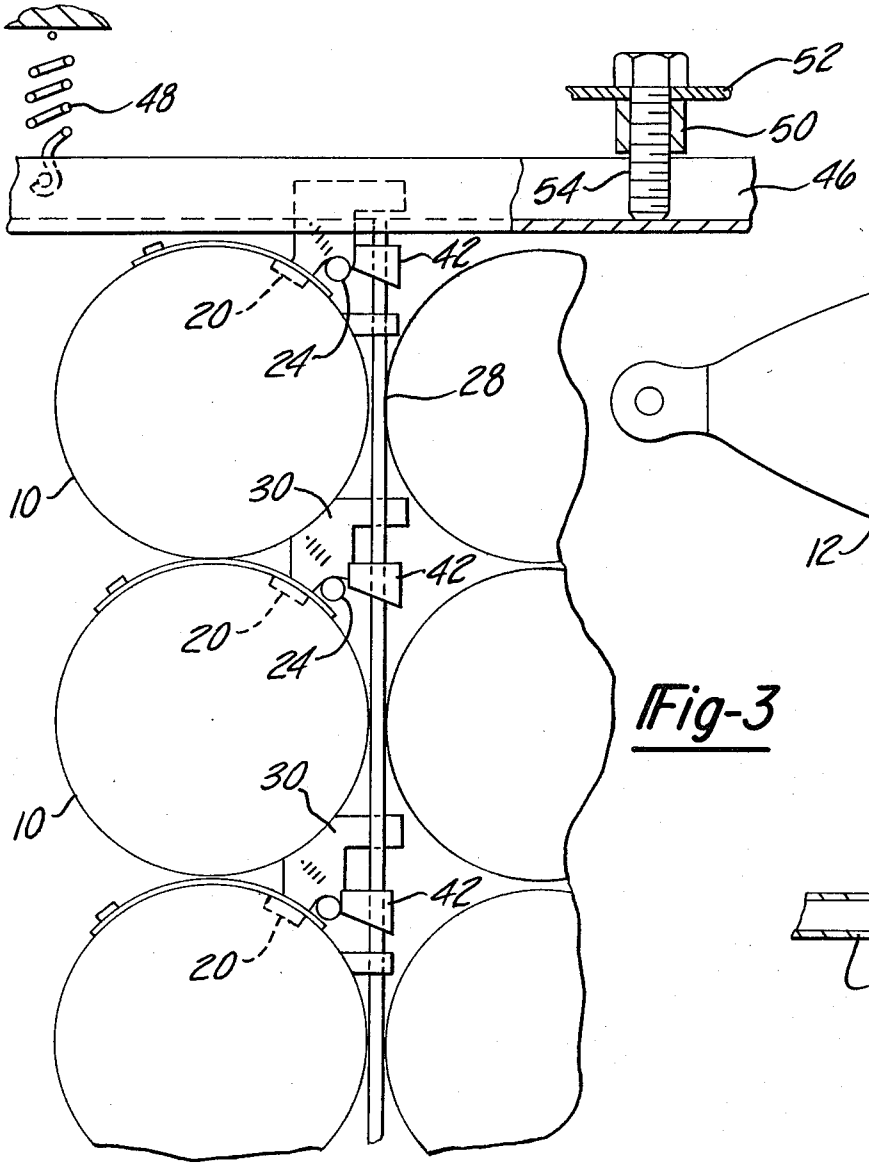

By way of a general description of the system, each round of ammunition 12 is clamped in its support tube 10 by a clamp structure that includes a pad 20 carried on a leaf spring 22; a manually-swingable arm 24 bears on the leaf spring upper surface. FIG. 1 shows on of the pads 20 in a released position spaced from the associated rounds, and two other pads in locked positions engaged with the associated rounds. FIG. 3 shows all three pads 20 in their locked positions.

Each vertical row of ammunition support tubes is equipped with a gang type actuator means that includes a vertical bar 28 having a multiplicity of cam elements 42 affixed thereto at spaced points related to the spacing of the various operator arms 24. Each vertical bar 28 is (or may be) attached to an overhead beam 46 for reciprocatable vertical motion from the FIG. 1 standby position to the FIG. 3 locked position, and return. The term "standby" is used to mean inactive or not effective on the clamp structures comprised of elements 20, 22 and 24. The term "locked" is applied to the gang type actuator means to signify that all of the clamp structures 20 associated with bars 28 are in their locked conditions.

When the gang type actuator means is in its locked position (FIG. 3) none of the clamp structures can be unlocked or released from the associated ammunition rounds. When the gang type actuator means is in its standby position (FIG. 1) the individual clamp structures can be either released from the associated rounds or clamped to the associated rounds. When it is desired to initially insert rounds of ammunition into the various support tubes 10 the gang type actuator bars 28 will be in their raised standby positions (FIG. 1); all of the individual operator arms 24 and clamp pads 20 will be displaced away from the associated support tubes. After rounds have been inserted into the various tubes 10 the gang type actuator means will be operated to the FIG. 3 locked position wherein all rounds are clamped against inadvertant dislodgement from the support tubes.

The gang type actuator means may be returned to its FIG. 1 standby position before or after the ammunition supply vehicle reaches the combat vehicle needing ammunition. With the gang type actuator means in its FIG. 1 standby position, the individual operator arms 24 may be selectively operated to release the associated clamping pads from the ammunition rounds, as required. The individual rounds can be removed from the individual support tubes only when pads 20 are in their released positions.

Figure 7:
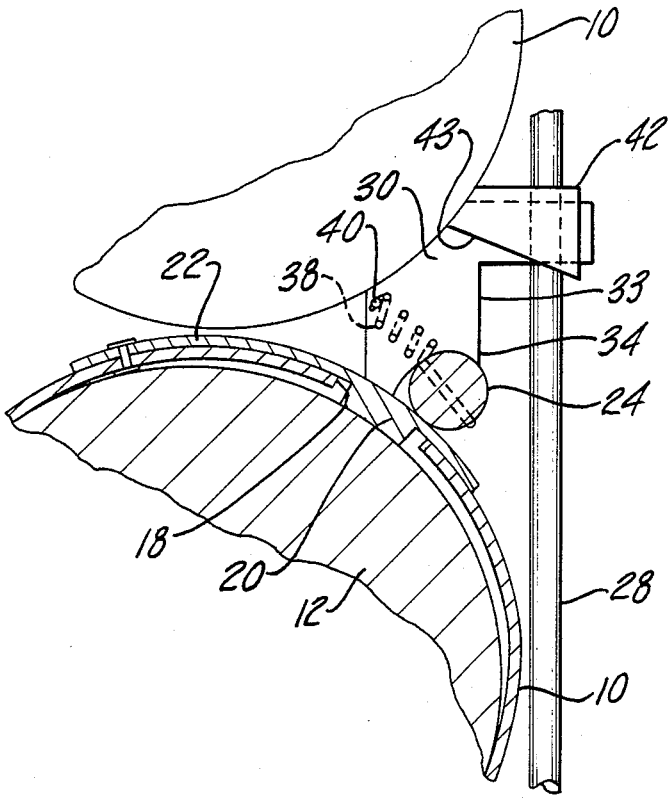
FIGS. 5 and 7 are fragmentary enlarged sectional views of the FIG. 1 structure, showing a manually-operated round clamp structure in two different positions of adjustment.
Figure 5:
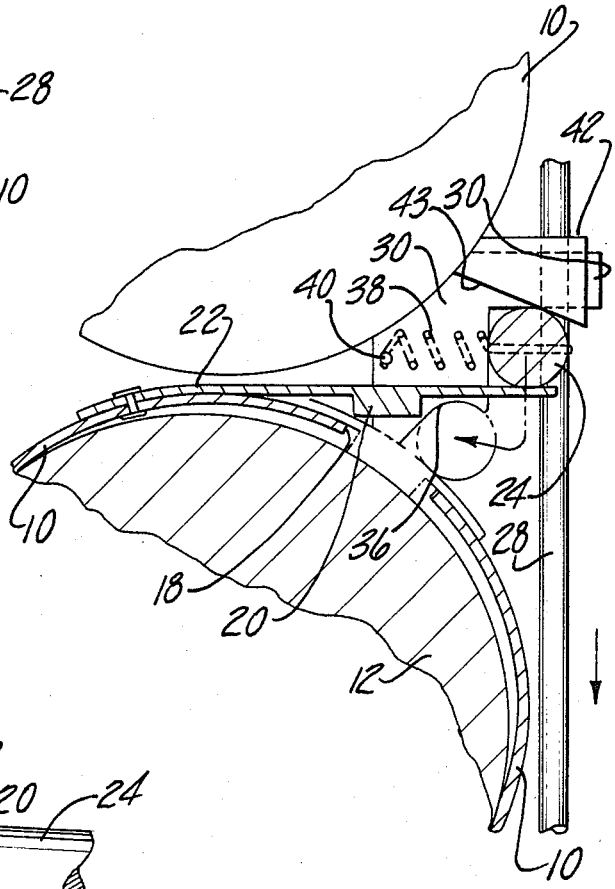

By way of a somewhat more detailed description of the mechanism, reference is made to FIGS. 5 and 7, which show one of the clamp structures in its released position (FIG. 5) and in its locked or retaining position (FIG. 7). The illustrated support tube 10 has a rectangular opening 18 in its wall for accommodating a round-engagement pad 20 carried by a leaf spring 22. The left end of each spring is riveted or otherwise affixed to the outer surface of the tube wall; the right end area of the leaf spring underlies an arm 24 that extends generally parallel to the tube 10 axis. The spring leaf is prestressed to exert an upward force on arm 24. Downward swinging motion of arm 24 around pivot 26 (FIG. 2) moves the spring leaf downwardly so that pad 20 moves through opening 18 into firm pressure engagement with the round of ammunition. Pad 20 serves as a clamping element for urging round 12 into frictional contact with the interior surface of the associated support tube 10.

Figure 6:
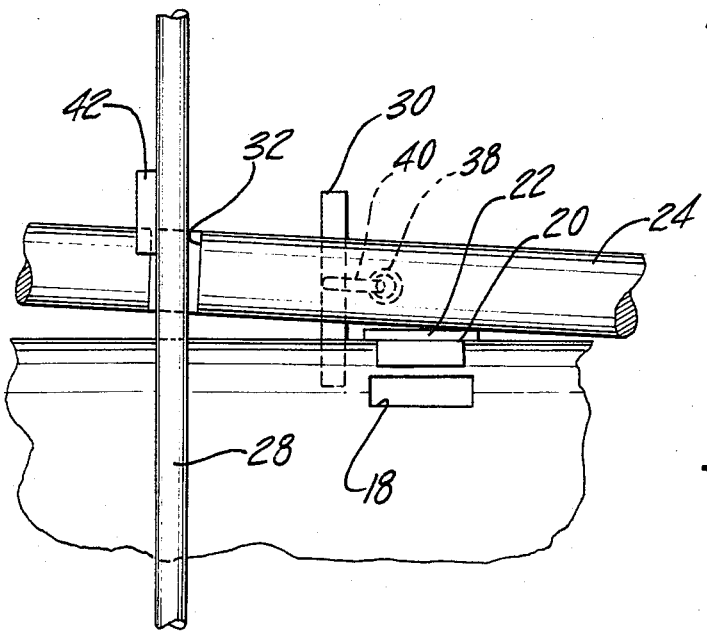
FIG. 6 is a right end view of the FIG. 5 mechanism.

Each arm 24 extends forwardly from its pivot 26 through a narrow restricted space or zone defined by a vertical bar 28 and a stationary flat plate 30. The arm may be provided with a slot 32 (FIG. 6) in its side surface enabling the arm to freely pass through the narrow zone between plate 30 and bar 28. The sole purpose for each slot 32 is to permit the associated bars 28 to have essentially zero clearance between tubes 10 in adjacent rows of tubes, thereby keeping the total horizontal rack space requirement as small as possible, commensurate with the tube 10 diameters.

The flat vertical edge 33 on each plate 30 constitutes a stationary guide means for confining arm 24 to motion in a vertical plane until the arm reaches a lip 34 leading to an arcuate notch 36 in the lower edge area of plate 30.

Each arm 24 is connected to one end of a tension coil spring 38. The other end of the spring is connected to a pin 40 (FIG. 6) carried by stationary plate 30. Spring 38 draws arm 24 against the edge of plate 30. When arm 24 reaches lip 34 the spring 38 force pulls the arm laterally into notch 36 (FIG. 7 position); pad 20 is then firmly clamped against ammunition round 12.

The pivot structure 26 (FIG. 2) is constructed so that arm 24 can move both vertically along the flat edge surface 33 and also horizontally into (or out of) notch 36. Notch 36 constitutes a latch structure for retaining arm 24 in its FIG. 7 position. Lip 34 prevents dislodgement of arm 24 out of notch 36 except by the application of a positive manual force in a direction opposite to the coil spring line of action. An extension tube 37 (FIG. 2) may be telescoped onto the front end of arm 24 to effectively increase the length of the arm and thereby lessen the manual force required to move the arm out of notch 36. When arm 24 is moved from the FIG. 7 "locked" position to the FIG. 5 released position leaf spring 22 moves pad 20 away from ammunition round 12. Arm 24 has slidable engagement on the upper surface of leaf spring 22.

The various arms 24 can be moved downwardly from the FIG. 5 "released" position to the FIG. 7 "locked" position downward motion of vertical bar 28 incident to the aforementioned gang type actuator lock action. Bar 28 carries multiple cam plates 42 at spaced points along it length, one cam plate for each arm 24 to be operated. Each cam plate defines a cam surface 43 obliquely angled to the bar 28 longitudinal axis, whereby downward motion of the bar causes cam surface 43 to move arm 24 downwardly. When each arm 24 reaches the associated lip 34 coil spring 38 draws the arm into a detained position in notch 36. All arms 24 associated with a given bar 28 are operated simultaneously. Vertical bar 28 may be guided for vertical motion by any suitable guide means. Such guide means are shown schematically at 44 in FIG. 1. Upward motion of bar 28 takes place after the associated arms 24 are in their detained positions in notches 36; therefore upward motion of bar 28 does not affect the condition of each associated arm 24. Each arm 24 is moved from the FIG. 7 "detained" position to the FIG. 5 "released" position by the use of manual force, e.g., by use of manual extension 37 (FIG. 2).

The number of bars 28 in the system will correspond to the number of rows of ammunition storage tubes, e.g., ten vertical rows of tubes would require ten gang actuator bars 28. The bars can be operated individually. Alternately the bars can be operated in groups or all at once, depending on the dictates of convenience, and practical considerations on operating forces and structual integrity factors. FIGS. 1 through 4 illustrate one representative overhead force mechanism for operating a plurality of the gang actuator bars 28 simultaneously. The mechanism comprises an overhead beam 46 suspended from stationary parts of the rack structure by tension springs, one of which is shown at 48; at least one additional tension spring would be located at the non-illustrated end of beam 46.

A centrally-disposed nut 50 is affixed to stationary rack structure 52 to receive a bolt 54 that bears on an upper surface of beam 46. Wrench-turning of bolt 54 causes the beam to be moved downwardly from the FIG. 1 position to the FIG. 3 position. Attached actuator bars 28 are thereby moved downwardly for causing the associated cams 42 to move arms 24 from their elevated positions (in which pads 20 are released from the associated rounds 12) to their lowered positions (in which pads 20 are clamped against the associated rounds). When bolt 54 is wrench-turned in a reverse direction springs 48 move beam 46 back to the FIG. 1 elevated position; attached bars 28 are raised with beam 46. Downward motion of bars 28 achieves gang type locking of all ammunition rounds in the system. Subsequent upward motion of the bars relocates cams 42 out of the path of motion of the various operator arms 24 for the individual clamp structures. Any selected clamp structure can be moved from its locked position (round clamped in the support tube) to its released position (pad 20 released from the associated round). FIG. 1 shows three arms 24; the upper and lower arms are shown in the locked or retained position, while the intermediate arm is shown in the unlocked or released position. I wish it to be understood that I do not desire to be limited to the exact details of construction shown and described for obvious modifications will occur to a person skilled in the art.

I claim:

1. In combination, parallel rows of tubes for storing individual rounds of ammunition therein;

a clamp structure associated with each tube for movement between a first position retaining the associated round in the tube, and a second position releasing the associated round for removal from the tube;

a stationary guide means (30) associated with each clamp structure, each stationary guide means terminating in a latch structure (34, 36);

each clamp structure comprising a spring leaf attached at one end thereof to an ammunition storage tube, a round-engagement pad carried by the leaf spring, a manually operable arm extending approximately parallel to the tube axis in crossing relation to the associated leaf spring, said arm being swingably mounted for motion along the associated guide means to and from a captured position engaged with the latch structure, and tension spring means (38) connected to each swingable arm for pulling said arm against the guide means and into the latch structure; said arm having pressure contact with the leaf spring so that when the arm is engaged with the latch structure the associated pad is in its round-retaining position; said leaf spring having a pre-stress therein which causes said leaf spring to move the associated pad to a round-released position when the swingable arm is disengaged from the latch structure;

and reciprocatable gang type actuator means for operating the clamp structures in each row of tubes to their round-retaining positions; each gang type actuator means being movable from a first standby position in which all clamp structures in the row are permitted to be in their round-released positions to a second locked position in which all clamp structures in the row are in their round-retaining positions;

each gang type actuator means comprising an elongated bar extending between two rows of ammunition storage tubes for longitudinal motion normal to the storage tube axes, and multiple cams carried by the bar at spaced points along the bar length, each cam defining a cam surface obliquely angled to the bar longitudinal axis; each cam having a motion path passing through an associated swingable arm, whereby motion of the elongated bar in one direction enables the cam to move the associated arm along the aforementioned guide means and into its captured position engaged with the latch structure, said cams being disengagable from the associated arms whereby motion of the elongated bar in the opposite direction frees said arms for manual motion out of their captured positions engaged with the latch structure.

2. The combination of claim 1 wherein each stationary guide means defines a guide surface (33) extending parallel to the associated elongated bar; each associated arm extending through the space between the guide surface and elongated bar.

3. The combination of claim 1 wherein each stationary guide means defines a guide surface extending parallel to the associated elongated bar each latch structure comprising a notch (36) formed in the guide means in near adjacency to an outer surface area of the associated tube, said notch defining a lip (34) at the juncture with the guide surface; said tension spring means being oriented so that when the arm reaches the notch the tension spring means automatically draws the arm into the notch, said lip being oriented to prevent dislodgement of the arm out of the notch except by the application of a positive manual force overcoming the force of the tension spring means.

* * * * *